US008646112B2

(12) United States Patent
Nix et al.

(10) Patent No.: US 8,646,112 B2
(45) Date of Patent: Feb. 11, 2014

(54) REINFORCING ELEMENT FOR A GLOVE, AND GLOVE, IN PARTICULAR A GOAL KEEPER'S GLOVE HAVING SUCH A REINFORCING ELEMENT

(75) Inventors: Christof Nix, Nuremberg (DE); Thomas Schwarz, Winkelhaid (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 13/518,688

(22) PCT Filed: Dec. 14, 2010

(86) PCT No.: PCT/EP2010/007588

§ 371 (c)(1),
(2), (4) Date: Jun. 28, 2012

(87) PCT Pub. No.: WO2011/076353

PCT Pub. Date: Jun. 30, 2011

(65) Prior Publication Data

US 2012/0266357 A1 Oct. 25, 2012

(30) Foreign Application Priority Data

Dec. 23, 2009 (DE) ..... 20 2009 017 473 U

(51) Int. Cl.
*A41D 13/00* (2006.01)

(52) U.S. Cl.
USPC ..... 2/16; 2/163; 2/161.1

(58) Field of Classification Search
USPC ..... 2/16, 20, 161.1, 161.6, 163
See application file for complete search history.

(56) References Cited

U.S. PATENT DOCUMENTS

| | | | | |
|---|---|---|---|---|
| 3,170,460 | A | 2/1965 | Stilson | |
| 5,232,436 | A | 8/1993 | Janevski | |
| 6,584,615 | B1 | 7/2003 | Wilder et al. | |
| 2007/0226866 | A1 * | 10/2007 | Geyer et al. | 2/16 |
| 2009/0307821 | A1 * | 12/2009 | Chang | 2/21 |

FOREIGN PATENT DOCUMENTS

| | | |
|---|---|---|
| EP | 1378273 | 1/2004 |
| EP | 1527802 | 5/2005 |
| EP | 1707246 | 10/2006 |

* cited by examiner

*Primary Examiner* — Katherine Moran
(74) *Attorney, Agent, or Firm* — Lucas & Mercanti, LLP

(57) ABSTRACT

The invention relates to a reinforcement element for a glove, especially for a goal keeper's glove, which is designed to allow a bending in a first bending direction and to prevent a bending in a second bending direction which is contrariwise to the first bending direction. To prevent reliably that the joints of the fingers are subjected to high forces during fisting of a ball, the invention is characterized in that the reinforcement element comprises two bending elements which extend in a longitudinal direction of a finger, which bending elements comprise a number of blocking elements for the prevention of a bending in the second bending direction, wherein the two bending elements run during regular use laterally beside the finger which is to be protected, wherein the two bending elements are connected to another by at least two connecting bridges. Furthermore, the invention relates to a glove, especially to a goal keeper's glove with such a reinforcing element.

13 Claims, 8 Drawing Sheets

Figure 1:
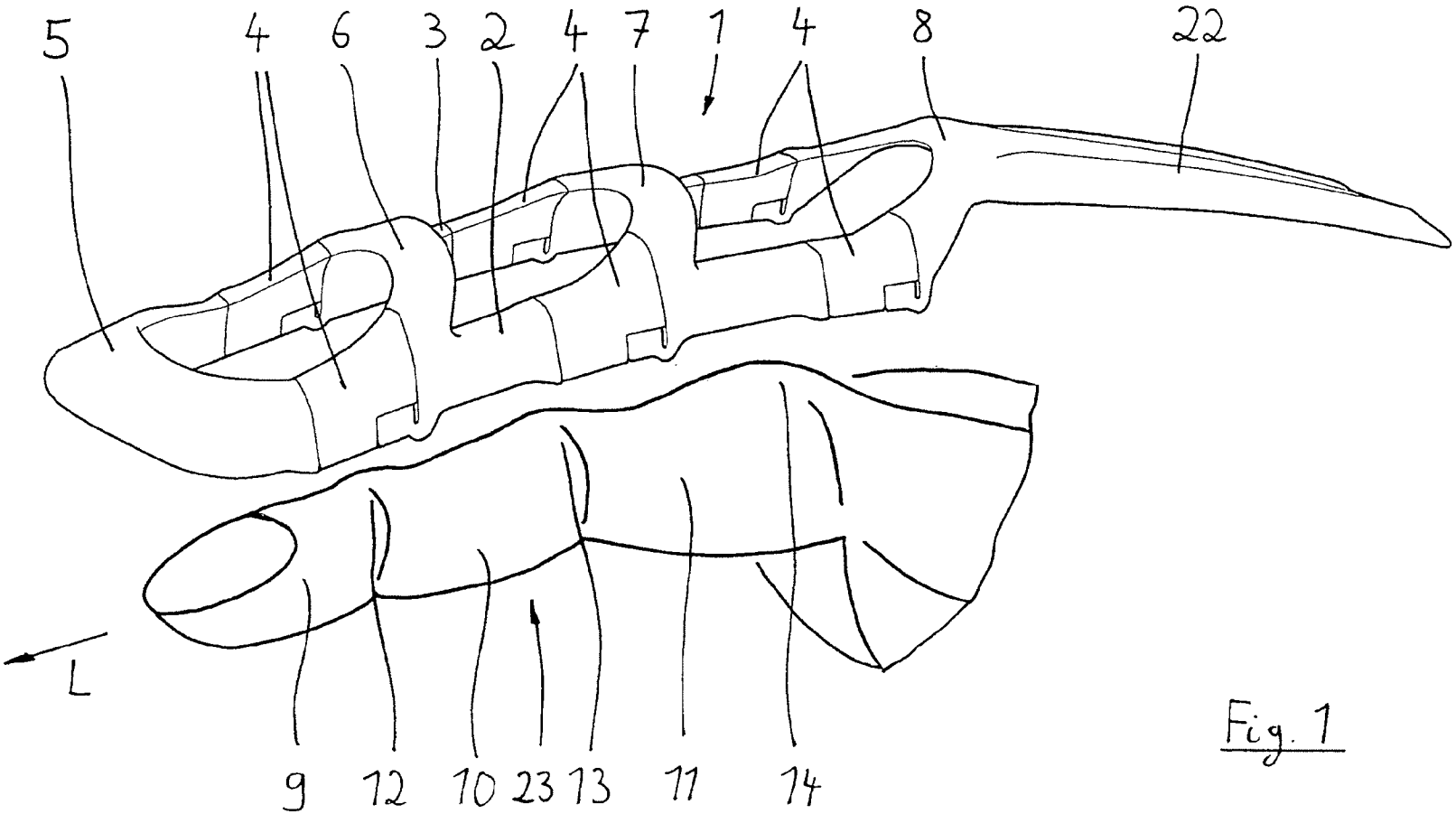

REINFORCING ELEMENT FOR A GLOVE, AND GLOVE, IN PARTICULAR A GOAL KEEPER'S GLOVE HAVING SUCH A REINFORCING ELEMENT

This is a National Phase under 35 U.S.C. 371 of International Application PCT/EP2010/007588, filed on Dec. 14, 2010, which claimed the priority of German Application No. 20 2009 017 473.5, filed Dec. 23, 2009, the entire content of both Applications are hereby incorporated by reference.

The invention refers to a reinforcement element for a glove, especially for a goal keeper's glove, which is developed to allow a bending in a first bending direction and to prevent a bending in a second bending direction which is contrariwise to the first bending direction. Furthermore the invention refers to a glove, especially to a goal keeper's glove with such a reinforcement element.

A reinforcement element of this kind for a goal keeper's glove is known from EP 1 527 802 B1. With such it is possible to set a protection to that effect that the goal keeper's fingers won't be bent over and so get overstretched during use of the goal keeper's glove in case of catching a ball. Meanwhile it is possible to bend the fingers in formation of a fist which means, the reinforcement element allows this movement of the finger. For this purpose it is intended by the pre-known solution that a section of the reinforcement element extends in the longitudinal direction of the finger which is bendable at first in both bending directions. To prevent the bending of the fingers "backwards" blocking elements are arranged in the section, which abut contrary to the anatomic direction during bending of the finger in a blocking way and so prevent the bending. The blocking elements thereby cover the complete back of the finger.

It is adverse in such a solution that the joint of the fingers abuts upon the blocking elements when during fisting of a ball a force is exerted on the outside of the finger. Accordingly, in this case the joints of the fingers will be subjected to a pressure which will be perceived as displeasing and even as painful respectively.

Thus, it is an object of the invention to further develop a reinforcement element of the kind mentioned above and to suggest a respective goal keeper's glove by which this disadvantage is prevented. Accordingly, it shall be prevented certainly during fisting of a ball that the joint of the fingers will be subjected to an intense pressure.

The solution of the object according to the invention is characterized in that the reinforcement element comprises two bending elements which extend in a longitudinal direction of a finger, which bending elements comprise a number of blocking elements for the prevention of a bending in the second bending direction, wherein the two bending elements run during regular use laterally beside the finger which is to be protected, wherein the two bending elements are connected to another by at least two connecting bridges.

Thereby, it can be provided that the blocking elements and the bending element which carry the blocking elements are designed as a one-piece plastic part. Alternatively, it can also be provided that that the blocking elements are produced as separate parts and are inserted into the bending element.

The at least two connecting bridges are preferably arranged in such a manner that the connecting bridges bridge the area of a phalanx and leave the area of the joint between two phalanxes respectively between one phalanx and the hand of the user uncovered during regular use.

Preferably, four connection bridges are arranged.

Preferably, at least a part of the connection bridges exhibit a concave design on its side which is faced to the finger to allow an optimized snuggling of the back of the finger.

Preferably, the two bending elements including the connection bridges are designed as a one-piece part which is mostly produced by an injection moulding process.

Preferably, the blocking element is connected with the bending element by a form-locking connection. The form-locking connection is preferably designed as a snap-action connection. A preferred embodiment of the invention proposes in this regard that the blocking element exhibits two hook-shaped protrusions which can engage behind a bar section of the bending elements. The two hook-shaped protrusions can be faced opposite to each other.

The blocking element can exhibit at least two lay-on surfaces which abut in a mounted state on the corresponding lay-on surfaces of the bending element. The two lay-on surfaces are preferably arranged orthogonal to each other to define a specified position in two axial directions for the blocking element.

Furthermore, the reinforcement element can have a substantial plane designed pressure distribution element in an axial end region. Thereby, the pressure distribution element and the two bending elements and the connection bridges can be designed as a one-piece part.

The bending element including the connection bridges and the blocking elements consist preferably of plastic material.

Furthermore, the invention relates to a glove, especially to a goal keeper's glove, which is equipped with at least one reinforcement element of the kind described above, preferably with several reinforcement elements for the different fingers.

Advantageously it is thus achieved, that the finger of the goal keeper will be protected in a revised way against over-expansion. The joints of the finger cannot any more contact the reinforcement element and cannot be pressed against the same so that a revised protection is given.

In the drawings embodiments of the invention are shown.

Figure 2:
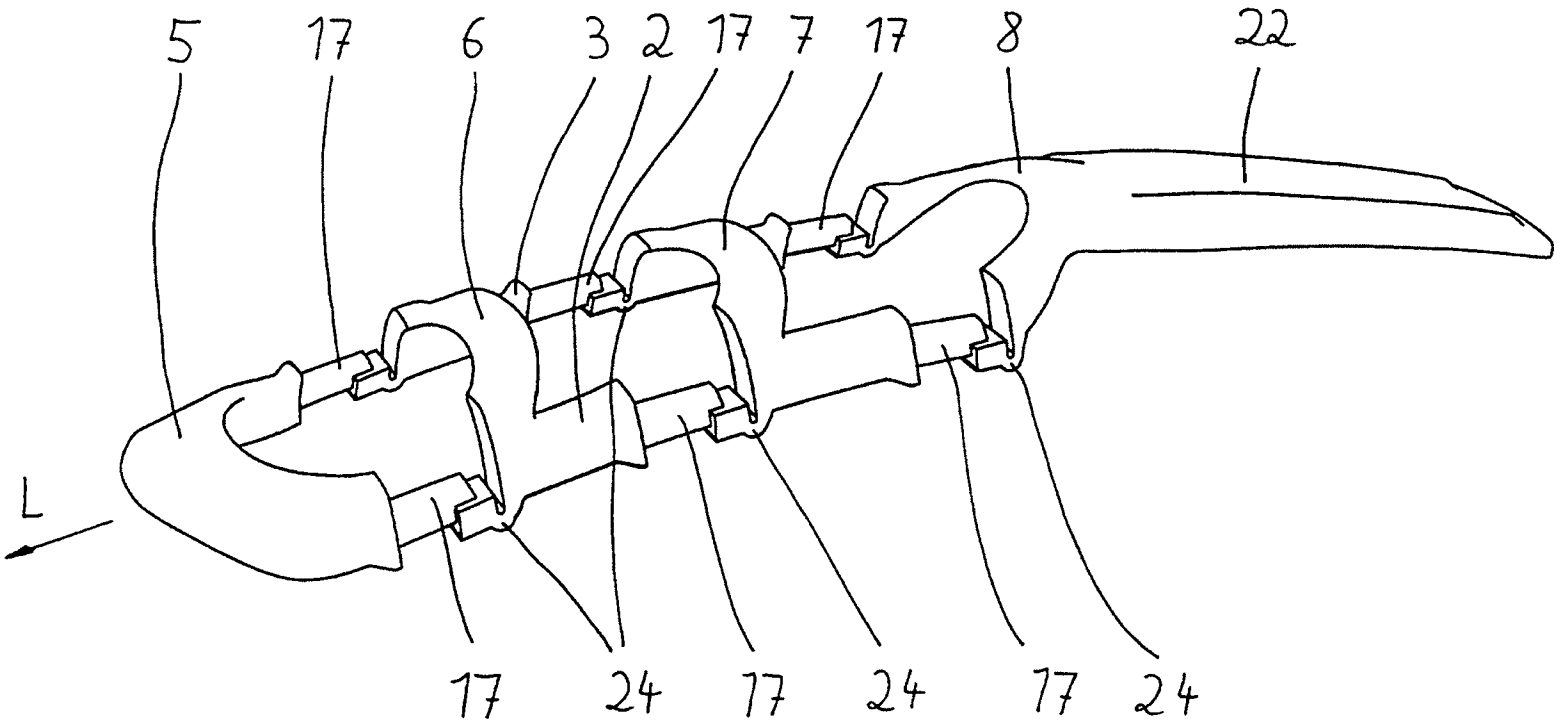
Figure 3:
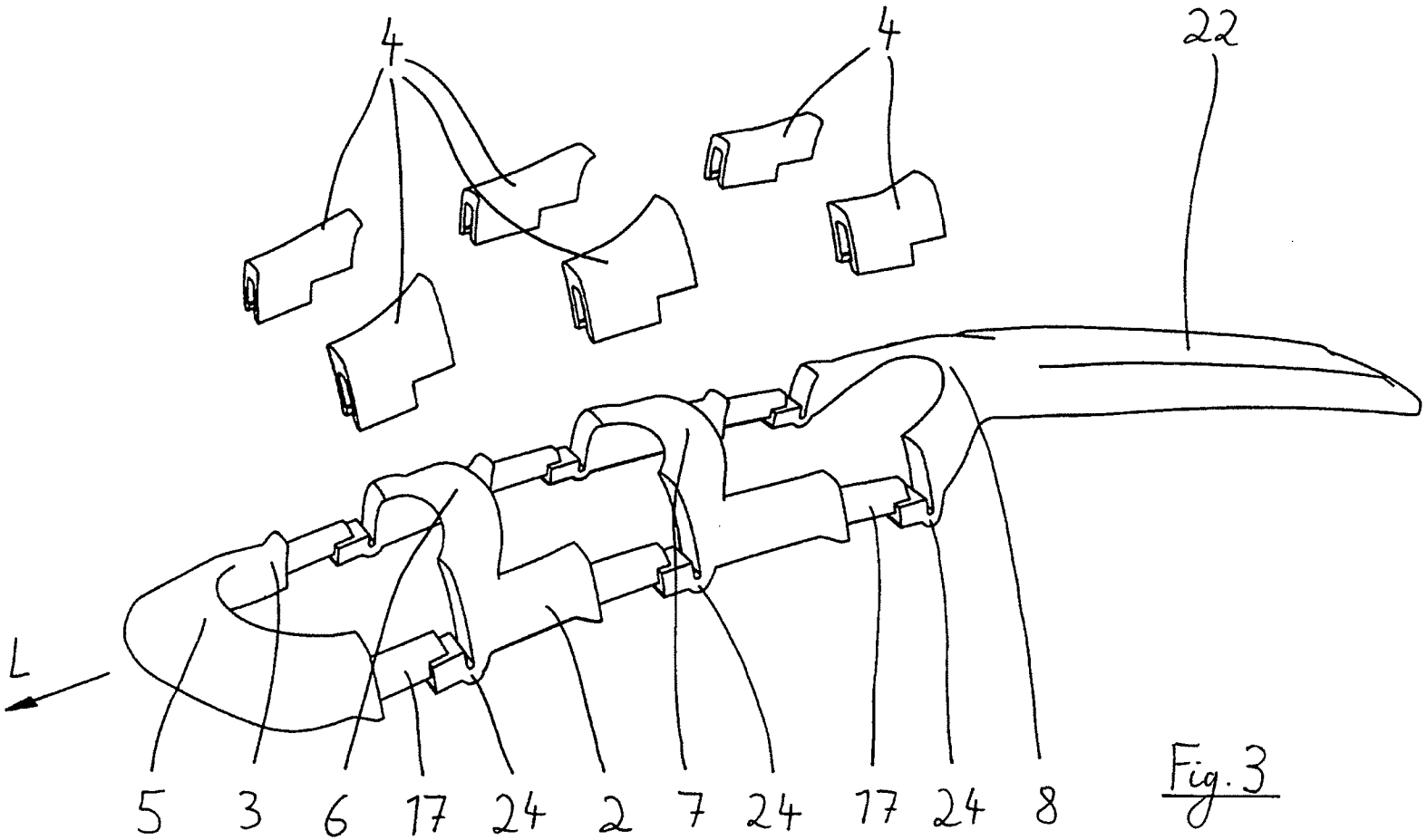
Figure 4:
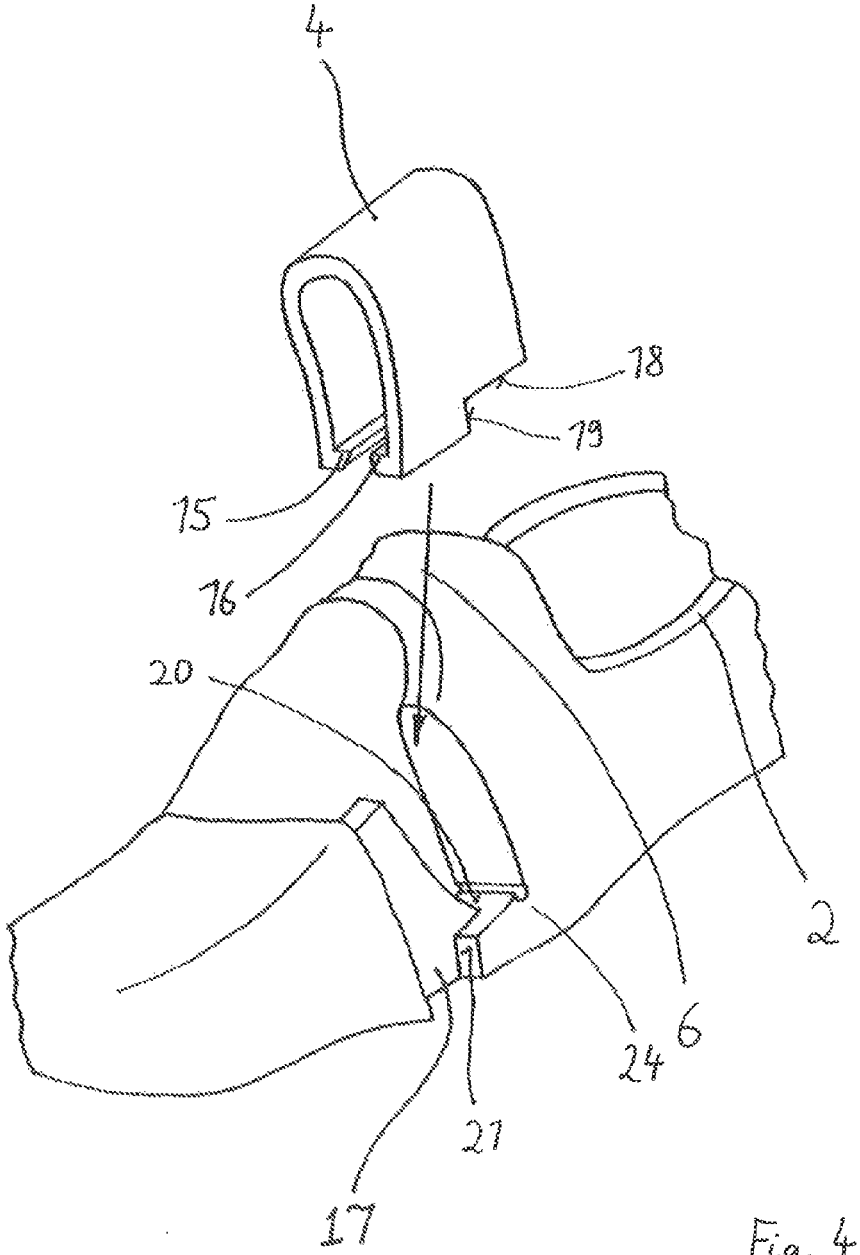
Figure 5A:
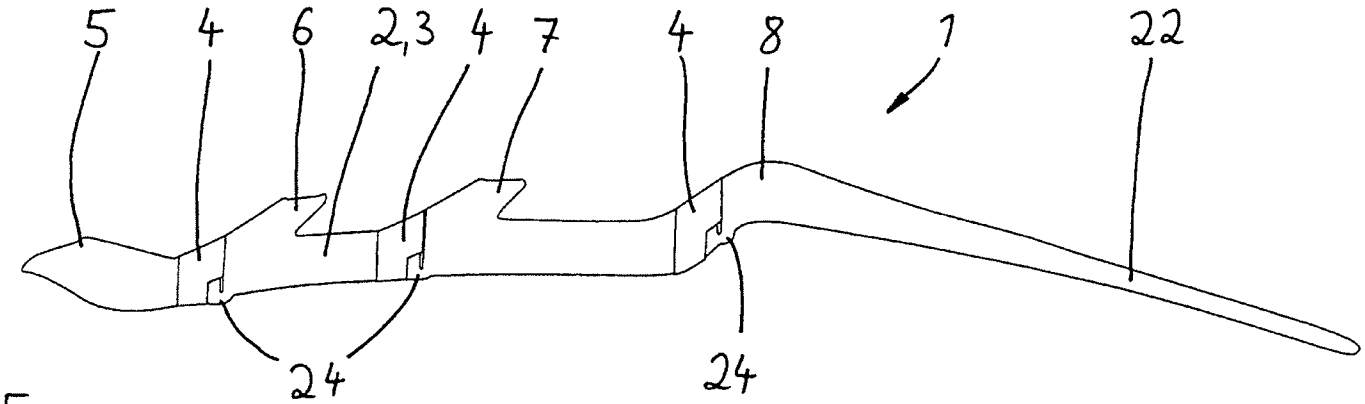
Figure 5B:
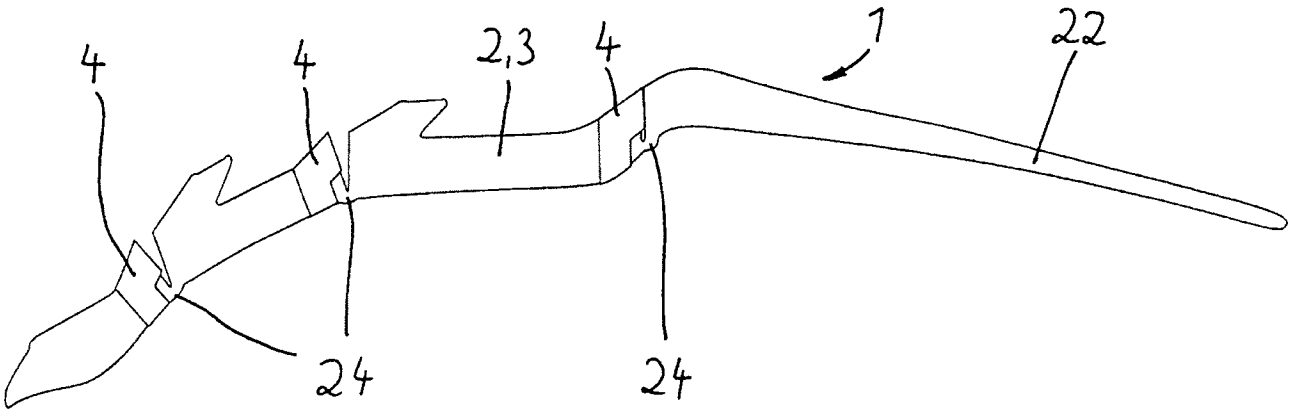
Figure 6:
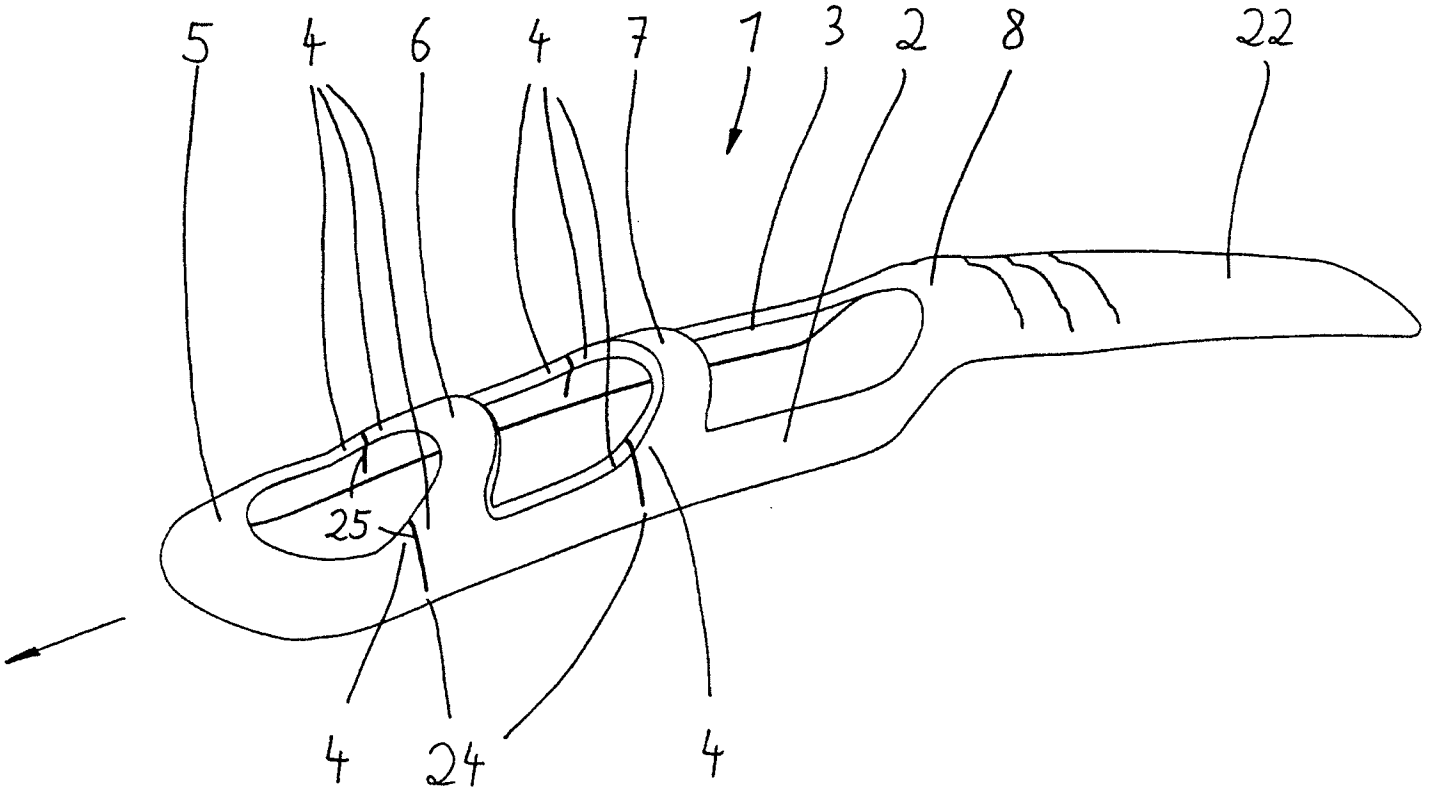
Figure 7:
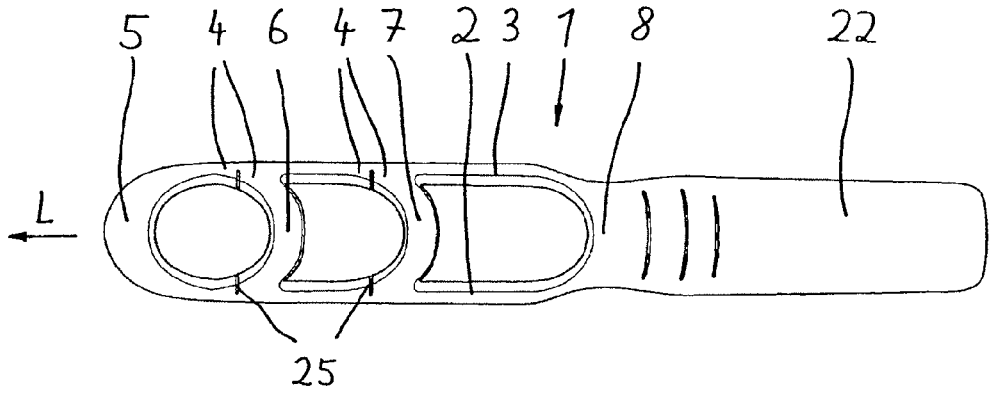
Figure 8:
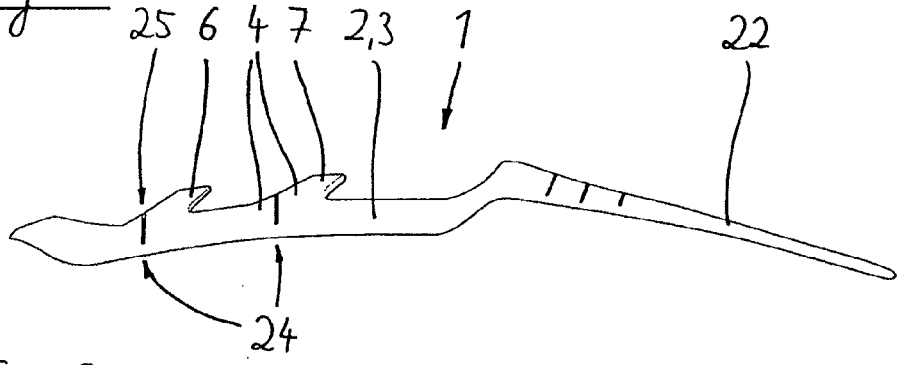
Figure 9:
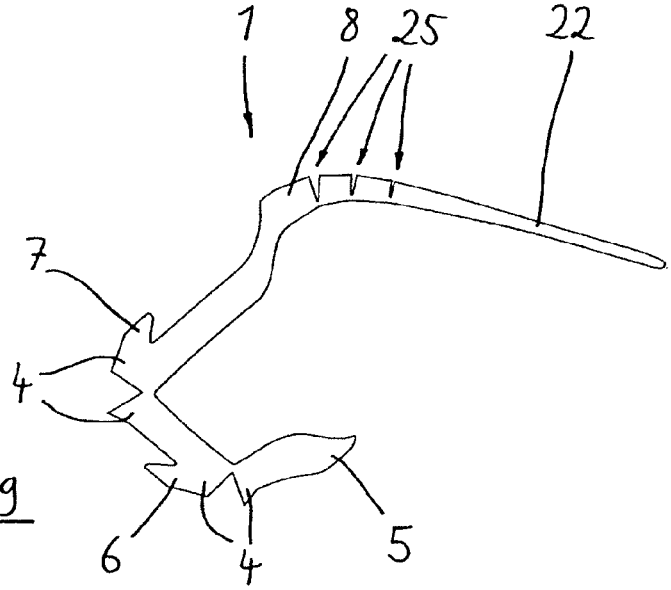
Figure 11:
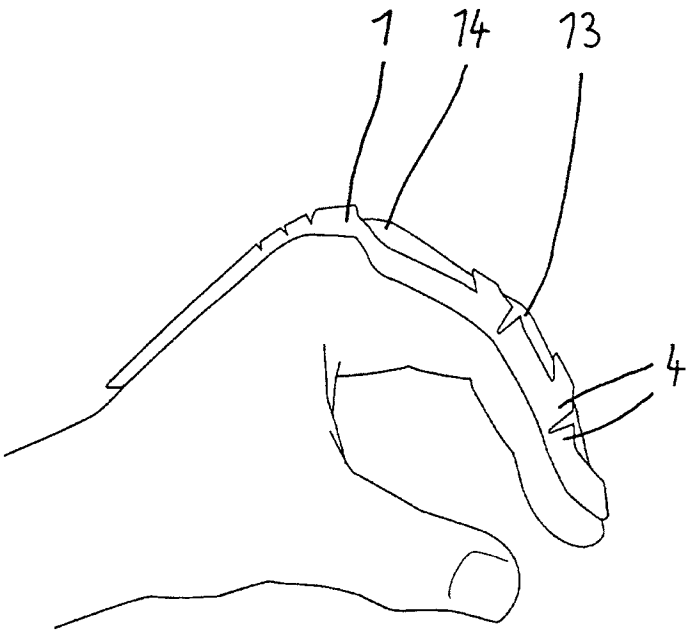
Figure 10:
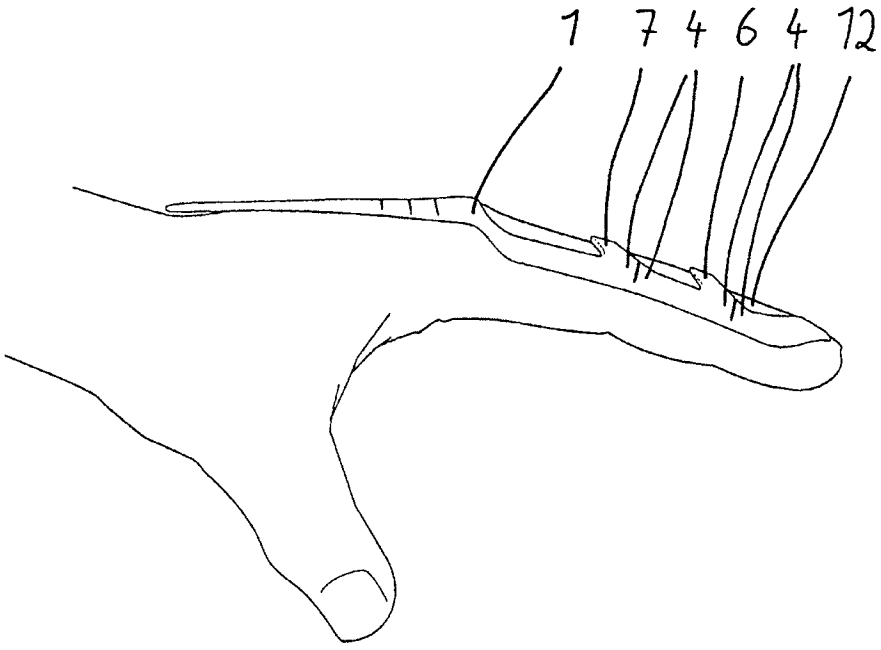

FIG. 1 shows a perspective view of a reinforcement element according to a first embodiment of the invention which can be integrated in a not depicted goal keeper's glove, wherein the finger which is to be protected is shown below the reinforcement element, FIG. 2 shows the base part of the reinforcement element without inserted blocking elements, FIG. 3 shows the base part of the reinforcement element without inserted blocking elements, wherein the blocking elements which are to be inserted are shown in exploded view, FIG. 4 shows a section of the reinforcement element in an enhanced exploded view, FIG. 5*a* shows the lateral view of the reinforcement element in a blocking position, FIG. 5*b* shows the lateral view of the reinforcement element in the position in which the fingers (not depicted) curl into a fist and the reinforcement element follows the motion of the fingers, FIG. 6 shows a perspective view of a reinforcement element according to a second embodiment of the invention, FIG. 7 shows the plan view of the reinforcement element according to FIG. 6, FIG. 8 shows the lateral view of the reinforcement element according to FIG. 6 in an elongated state of the reinforcement element, FIG. 9 shows the lateral view of the reinforcement element according to FIG. 6 in a state in which the hand is formed into a fist, FIG. 10 shows a perspective view of the reinforcement element according to FIG. 6 on a hand of a goal keeper, wherein the fingers are elongated and FIG. 11 shows a perspective view of the reinforcement element according to FIG. 6 on a hand of a goal keeper, wherein the fingers are rounded inwards.

The FIGS. 1 to 3 show all an embodiment according to the invention of a reinforcement element 1 for a not depicted goal keeper's glove or parts of the same. The reinforcement element 1 has substantially two bending elements 2 and 3, which are arranged laterally next to a finger 23 to be protected during regular use of the reinforcement element 1, which finger is shown in FIG. 1 below the reinforcement element 1; during use of the reinforcement element and the goal keeper's glove respectively the reinforcement element 1 rests functionally on the back of the finger 23, wherefore it is positioned mostly in a suitable containing pocket in the goal keeper's glove.

The two bending elements 2, 3 extend substantially in longitudinal direction of the finger L. Thereby stronger developed and less developed sections alternate in the mentioned direction. Bar sections 17 (see particularly FIG. 2) are relatively slight developed which are performed smaller compared to the dimensions of bending elements 2, 3.

In the area of bar sections 17 an in connection to the onward extension of the bending elements 2, 3, hinge-joint sections 24 are arranged which allow that the bending element 2, 3 can be bent without a significant bending torque at that position. Accordingly, the reinforcement strip can follow the bending of the finger in case of building a fist.

So that this doesn't occur in the opposite direction, which means to protect the finger from an overexpansion backwards, blocking elements 4 are provided that can be attached and inserted respectively in the area of the bar section 17 onto the bending elements 2, 3. As an immediate result—look therefore particularly FIG. 1—, this causes in this case that the end face of the blocking elements abut upon the corresponding lay-on surface on the bending elements 2, 3, so that a resistance will be subtended for the bending "backwards".

Insofar, the reinforcement element constitutes a function which is known as such. I.e. the reinforcement element 1 is developed to allow a bending in a first bending direction (that is to say in the anatomic designed bending direction of the finger) and to prevent a bending in a second bending direction which is opposite to the first bending directions and thus protects the finger.

Meanwhile, it is essential that the reinforcement element 1 comprises two bending elements 2, 3 which extend in a longitudinal direction L of a finger, which bending elements 2, 3 comprise a number of blocking elements 4 for the prevention of a bending in the second bending direction. The two bending elements 2, 3 run during regular use laterally beside the finger 23. The two bending elements 2, 3 are connected to another by at least two connecting bridges 5, 6, 7, 8, in the present case by four of such connection bridges which are preferably designed arc-like.

Furthermore, it is very advantageous that the connecting bridges 5, 6, 7, and 8 are arranged in such a way that during regular use the connecting bridges bridge the area of a phalanx 9, 10 and 11 respectively—see for this FIG. 1. Meanwhile the area of a joint 12, 13 and 14 respectively will be left uncovered between two phalanxes 9 and 10 and 10 and 11 respectively between a phalanx 11 and the hand of the user. The result of it is, that the joints 12, 13, 14 are not exposed to any danger that they pitch against the reinforcement element 1 during fisting of a ball.

The blocking elements 4 are attached onto the bar sections 17 by a form-closed connection and are here connected with the bending elements 2, 3. Details for this emanate best from FIG. 4. The blocking element 4 exhibits in its lower area two hook-shaped protrusions 15, 16. These are developed to reach behind the bottom side of the bar section 17 when the blocking element 4 is inserted in the direction of arrow in FIG. 4 upon the bending element 2, 3 in the recess which is arranged therefore.

Accordingly, the blocking element 4 will be fixed on the bending element 2, 3 with the hook-shaped protrusions 15, 16 which form a snap joint.

A defined lay-on of the blocking element 4 on the bending element 2, 3 results due to lay-on surfaces 18, 19 which are arranged on the lower side of the blocking element 4. These lay-on surfaces 18, 19 have corresponding lay-on surfaces 20, 21 on the bar section 17 of the bending element 2, 3.

Accordingly, the lay-on surface 18 of the blocking element 4 attaches at the lay-on surface 20 of the bar section; correspondingly, the lay-on surface 19 of the blocking element 4 attaches on the lay-on surface 21 of the bar section 17.

Since the two lay-on surfaces 18 and 19 and 20 and 21 respectively are arranged orthogonal to each other a defined lay-on of the blocking element 4 on the bending element 2, 3 results in two axial directions.

The reinforcement element 1 has a pressure distribution element 22 in one of its axial end sections which is developed lamellar and substantially even. It is suited to be anchored within the goal keeper's glove and to distribute the bending pressure upon the back of the hand.

The way of function of the reinforcement element 1 emanates again from the FIGS. 5*a* and 5*b*.

In FIG. 5*a* the reinforcement element 1 is in its elongated position where the blocking element 4 prevents that there will be a bending of the fingers "backwards", i.e. to an over bending of the fingers.

Meanwhile the reinforcement element 1 follows according to FIG. 5*b* the movement of the finger when they bend themselves into a fist on an anatomic correct way.

In FIGS. 6 to 11 a reinforcement element 1 is depicted in an alternative embodiment of the invention.

The synopsis of the FIGS. 6, 7, and 8 shows the basic structure of the reinforcement element 1. The difference between the preceding discussed solution consists substantially therein that no separate blocking elements 4 are used, which are manufactured as individual formed components and are then attached onto the bending elements 2, 3. In fact material sections of the bending elements 2, 3 affect here functional as blocking elements 4. Namely, the reinforcement element 1 which is manufactured as a one-piece formed component by injection moulding exhibits insections 25 in the area of the bending elements 2, 3, so that the remained material area builds a hinge joint section 24 in which the insection 25 doesn't extend.

Accordingly, the reinforcement element 1 can be bent here to be able to follow the form of the finger during fisting of the hand.

This following of the bending of the finger is illustrated in FIG. 9 where can be seen how the reinforcement element 1 deforms due to the bending of the fingers in comparison with FIG. 8.

How this looks in the practical use within a goal keeper's glove, results from the synopsis of the FIGS. 10 and 11, where a hand of a goal keeper is depicted, wherein the reinforcement strip for one finger is shown which is placed in a suitable containing pocket of a not depicted goal keeper's glove.

In FIG. 10 it can be seen how the reinforcement strip 1 rests upon an elongated finger. Here, the blocking elements 4 recline to one another so that a bending of the finger will be prevented against the anatomic direction.

Meanwhile it results from FIG. 11 how the reinforcement element 1 follows the bending of the fingers during fisting of the hand. It is essential that the joints 12, 13, 14 stay free and are consequently not charged by the reinforcement element 1.

LIST OF REFERENCES

1 Reinforcement element
2 Bending element
3 Bending element
4 Blocking element
5 Connecting bridge
6 Connecting bridge
7 Connecting bridge
8 Connecting bridge
9 Phalanx
10 Phalanx
11 Phalanx
12 Joint
13 Joint
14 Joint
15 Hook-shaped protrusion
16 Hook-shaped protrusion
17 Bar section
18 Lay-on surface
19 Lay-on surface
20 Lay-on surface
21 Lay-on surface
22 Pressure distribution element
23 Finger
24 Hinge joint section
25 Insection
L Longitudinal direction of the finger

The invention claimed is:

1. A reinforcement element for a glove, which is designed to allow a bending in a first bending direction and to prevent a bending in a second bending direction which is contrariwise to the first bending direction, wherein the reinforcement element comprises:

two bending elements which are adapted to extend in a longitudinal direction of a finger, the bending elements comprise a number of blocking elements which prevent bending in the second bending direction, the two bending elements are adapted to extend laterally beside the finger which is to be protected and the two bending elements are connected to another by at least two connecting bridges, the at least two connecting bridges extend from one of the two bending elements to another of the two bending elements and transverse to the two bending elements such that each of the bridges is adapted to bridge over the top of a phalanx, each of the bridges is concave, facing the bottom, and an opening defined by an area between the two bending elements and two connecting bridges, the opening facing the top and adapted to allow a joint between two phalanxes to extend through the opening during regular use.

2. The reinforcement element of claim 1, wherein the blocking elements and the bending elements which carries the blocking elements are a one-piece plastic part.

3. The reinforcement element of claim 1, wherein the blocking elements are separate parts and inserted into the bending elements.

4. The reinforcement element of claim 3, wherein each blocking element is connected with each bending element by a form-locking connection.

5. The reinforcement element of claim 4, wherein the form-locking connection is a snap-action connection.

6. The reinforcement element of claim 5, wherein each blocking element has two hook-shaped protrusions which engage behind a bar section of the bending elements.

7. The reinforcement element of claim 6, wherein the two hook-shaped protrusions face opposite to each other.

8. The reinforcement element of claim 3, wherein each blocking element has at least two lay-on surfaces which abut in a mounted state on the corresponding lay-on surfaces of each bending element.

9. The reinforcement element of claim 8, wherein the two lay-on surfaces are arranged orthogonal to each other.

10. The reinforcement element of claim 1, wherein four connection bridges are arranged.

11. The reinforcement element of claim 1, wherein the two bending elements and the connection bridges are a one-piece part.

12. The reinforcement element of claim 1, wherein the bending elements including the connection bridges and the blocking elements consist of plastic material.

13. A glove having the reinforcing element of claim 1.

* * * * *